United States Patent [19]

Paulovits

[11] Patent Number: 4,832,531

[45] Date of Patent: May 23, 1989

[54] APPARATUS FOR LAYING SUBTERRANEAN PLASTIC TAPE AND PIPE

[75] Inventor: Ferenc Paulovits, Szép u. 5., 1053 Budapest, Hungary

[73] Assignee: Ferenc Paulovits, Budapest, Hungary

[21] Appl. No.: 139,252

[22] PCT Filed: Mar. 13, 1987

[86] PCT No.: PCT/HU87/00014

§ 371 Date: Dec. 28, 1987

§ 102(e) Date: Dec. 28, 1987

[87] PCT Pub. No.: WO87/05646

PCT Pub. Date: Sep. 24, 1987

[30] Foreign Application Priority Data

Mar. 14, 1986 [HU] Hungary ..... 1066

[51] Int. Cl.[4] ..... E02F 5/10; F16L 1/02

[52] U.S. Cl. ..... 405/176; 405/174

[58] Field of Search ..... 405/38, 156, 176, 179, 405/154, 174, 180, 183

[56] References Cited

U.S. PATENT DOCUMENTS

| | | | |
|---|---|---|---|
| 2,738,745 | 3/1956 | Harpold | 405/179 X |
| 3,217,500 | 11/1965 | Diamond et al. | 405/156 |
| 3,757,529 | 9/1973 | Kaercher | 405/176 |
| 4,437,789 | 3/1984 | Kasiewicz | 405/156 |

*Primary Examiner*—David H. Corbin

*Attorney, Agent, or Firm*—Schweitzer & Cornman

[57] ABSTRACT

Apparatus for simultaneously laying plastic tape and plastic pipe in an underground widened slit, wherein an earth slitting tool and wing type hollow laying head are attached to a frame for providing and underground widening a slit in the ground, means for dispensing plastic tape and plastic pipe, means for folding the plastic tape, and means for unfolding the plastic tape in the underground widened slit.

5 Claims, 4 Drawing Sheets

APPARATUS FOR LAYING SUBTERRANEAN PLASTIC TAPE AND PIPE

FIELD OF THE INVENTION

The invention relates to an apparatus used for laying subterranean plastic tape and pipe of the system referred to in the art as "subsoil irrigation combined with impermeable layer", to enable economical irrigation of row crops cultivated in sandy or highly permeable soils, under large-scale conditions.

BACKGROUND OF THE INVENTION

Subsoil irrigation combined with an impermeable layer has been known for a long time (for example by the trade name Hydrak). It is a method the essential feature of which is that an artificial, impermeable webbing is placed about 60 cm below the ground surface, at the depth of the root zone of the plants, and irrigation pipe is laid above the impermeable layer. With that process, the root zone of the plants is kept adequately moist even in soils with poor water retention, according to a program, without loss by evaporation and seepage, during the whole growth season. This produces high yield on barren, otherwise non-yielding terrain, independently from precipitation conditions. The root zone of the plants can be continuously supplied with dissolved plant protective agents and nutrients incorporated in the irrigating water, at a low cost while also protecting the environment.

A large scale use of that process was not possible so far due to the fact, that no means was available for the economical realization thereof.

Some experiments have been performed for the construction of suitable laying equipment. Such an experiment is described in the techincal periodical titled: "Kertgazdaság" (Hungary) No. 4 volume 7, p. 24–28, 1975. Apparatus named FÖLTERON-60 was used as a prototype in this experiment. The essential feature of that apparatus was that a wing-type subsoiler was fixed to a semi-suspended frame, and the plastic coil to be laid was arranged in a hollow rear part of the machine. The plastic irrigation pipe was guided from the large diameter fixed to the frame, to the upper part of the subsoiler, from where it passed to below the ground surface through the laying hole on the lower part of the tool.

This apparatus was not generally used in practice, because it was not possible to keep the laying equipment at a proper level and at a reliable adjustment. The plastic tape storage drum arranged at the bottom could not be controlled during operation and the traction power requirement of the apparatus was too high. Guiding the plate at the bottom resulted in further disadvantage in that only a small amount of plastic tape could be wound onto the small diameter drum, which hindered the continuity of the operation and reduced the productivity. Thus this machine was not suitable for the economical, large-scale realization of the HYDRAK process.

DESCRIPTION OF THE INVENTION

An object of the present invention is to provide apparatus for laying subterranean plastic tape and pipe, wherein the depth of laying is adjustable and is maintained reliably at a desired level, and wherein a productive speed of laying can be achieved without the need for frequently replacing the materials to be laid, embedding of the materials can continuously be checked during operation, the traction power requirement is relatively low, the apparatus can be produced at low cost, and is suitable for carrying out supplemental activities such as excavation of the trench for laying the main water line, backfilling the trench, incidentally laying vertical plastic tape, laying of two pipes at the same time, etc.

The invention is based on the recognition, that the plastic coil can be held relatively high above the ground surface if the tape is folded in half when guided into the wing-type subsoiler, and then it is spread to its full width below the ground surface. Furthermore, if an earth splitting tool is used before the laying head, and optionally if the tools of the laying equipment are being vibrated, the resistance to traction of the laying means is considerably reduced. The laying apparatus can be produced at a low cost if the tools are replaceably mounted on the frame.

The apparatus of the present invention is provided with a conventional frame, earth splitting tool, laying head formed as hollow wing-type subsoiler, pipe and plastic tape storage drums and, according to the invention, guiding elements for folding the plastic tape are arranged between the laying head and the plastic tape storage drum above it, while guiding elements for unfolding the folded plastic tape, i.e. guiding rollers forming concave duct are disposed in the lower, hollow part of the laying head; and the lower hollow part is covered at the back by an arch, furthermore a single-ported, curved sleeve pipe is placed in the internal hollow part of the laying head for guiding the pipes to be laid.

It is preferable to connect the laying head and earth splitting tool to a vibrator to reduce the resistance to traction and for easier embedding of the plastic tape and pipe to be laid.

According to a preferred embodiment, the laying head and the working tools are replaceably attached to the frame.

According to another preferred embodiment, the frame is driven and is connected to the impeller throughout hydraulic cylinders.

DESCRIPTION OF THE DRAWING

The apparatus according to the invention is described in detail, with reference being had to the drawing, in which.

DESCRIPTION OF PREFERRED EMBODIMENT

Figures 1, 2:
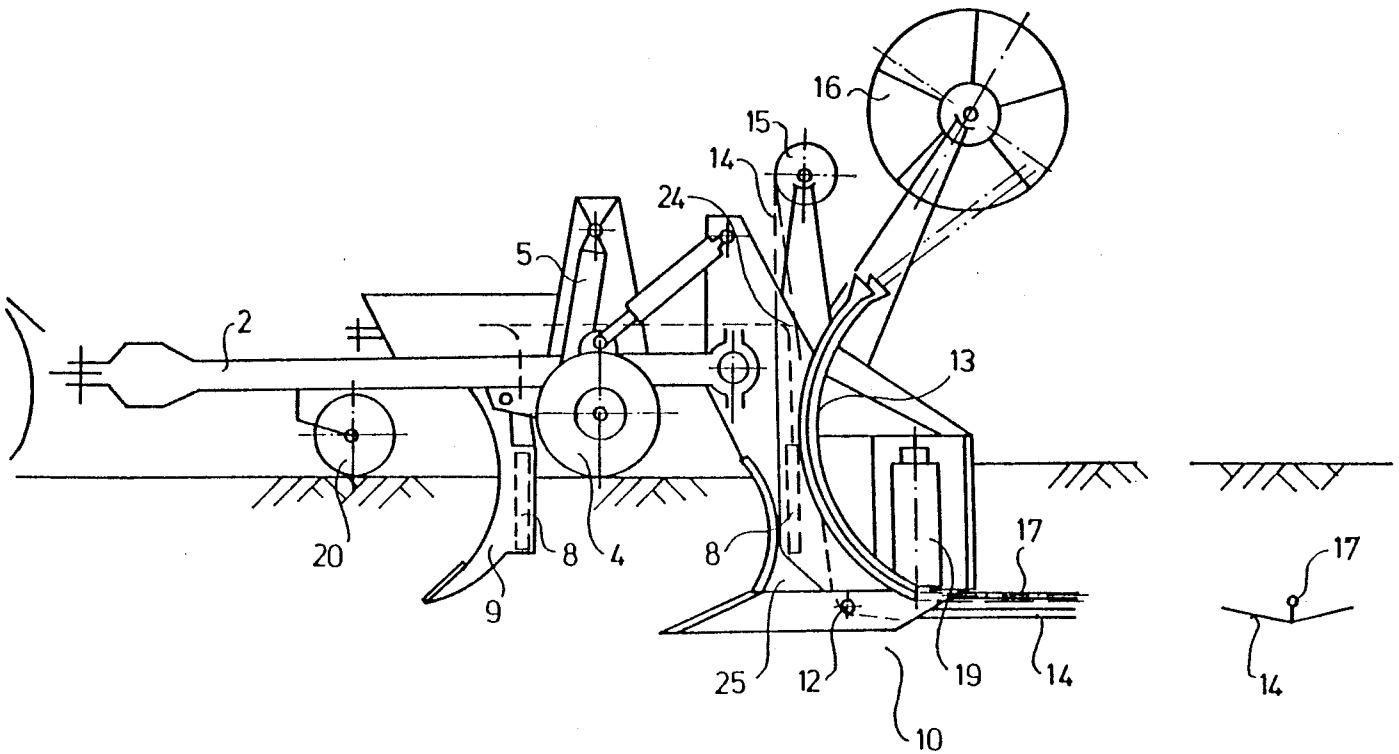
FIG. 1 is a schematic side view of the apparatus of the invention.
FIG. 2 is a schematic view of the soil profile with the embedded plastic duct and pipe.
Figure 3:
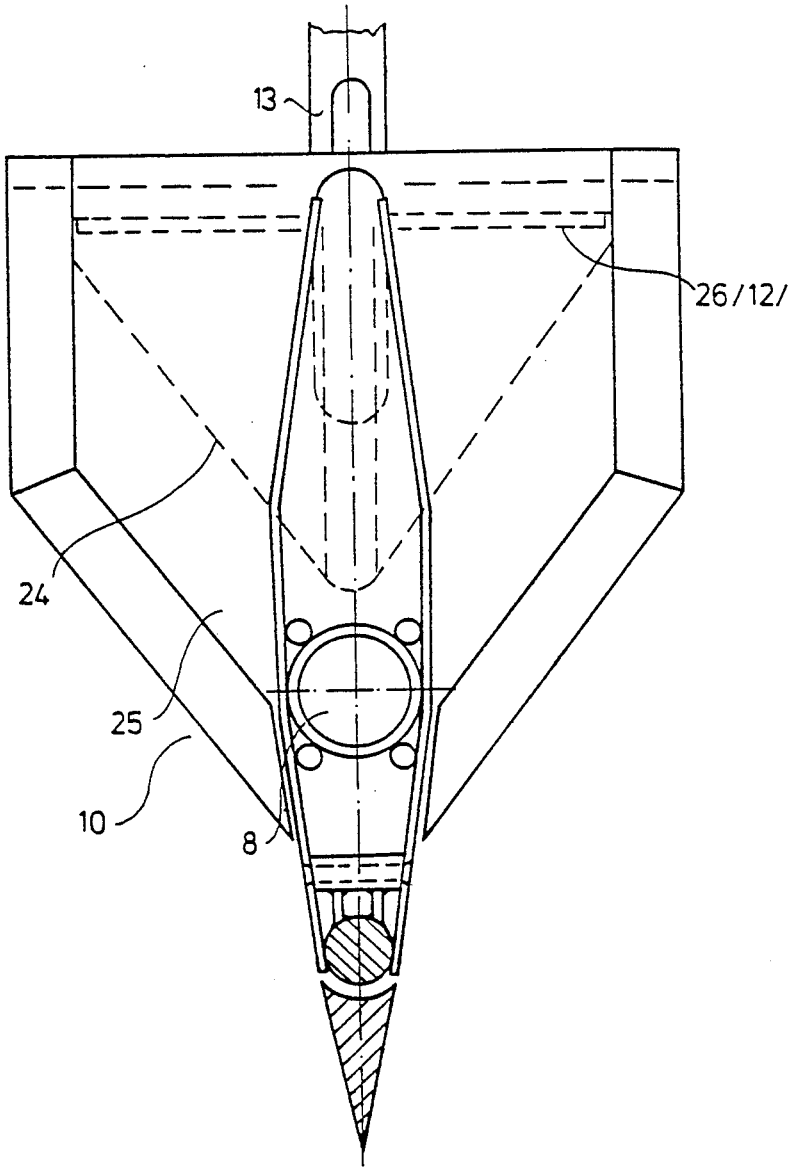
FIG. 3 is a partially cross-sectional view of the laying head of the apparatus of the invention.
Figure 4:
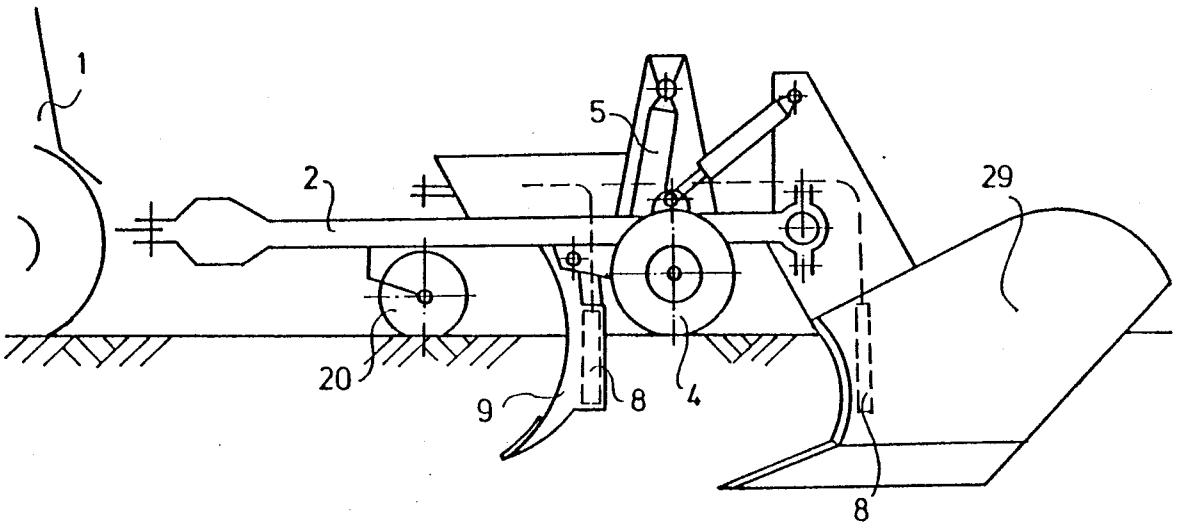
FIG. 4 is a side view of the frame with the trench excavating tool.
Figure 5:
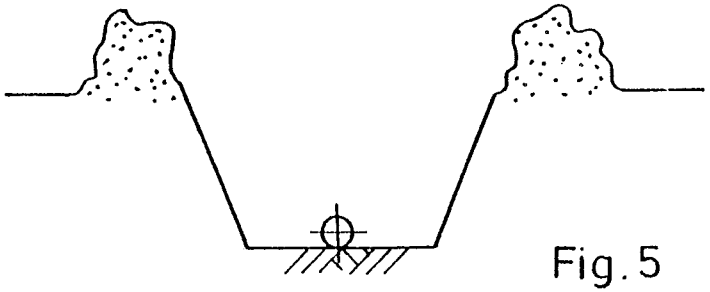
FIG. 5 is a schematic cross-sectional view of the trench.

FIG. 1 shows the rear part of a tractor 1, where a towing lug of frame 2 of the laying apparatus according to the invention is attached with the standard towing mechanism to the tractor 1. The apparatus shown in the drawing is in operative position, that is the tools of the equipment are disposed below the ground surface. The frame 2 is towed by the tractor 1. Its height in relation to the wheel 4 is steplessly adjustable with a hydraulic cylinders 5. The apparatus is shown in its extreme lower position, when the maximum working depth is about 800 mm. In the other extreme position (not shown) the equipment is in transportable position with the tools lifted above the ground surface. The frame 2 and its impeller are of conventional construction. It is advisable to mass produce the apparatus in the interest of low cost, as for example the Vibrolaz-80 type subsoiler.

Earth splitting tools, including for example a curved coulter 9 and a disc 20 are mounted from the front part of the frame 2. Both can be used at the same time, and since the working tools are replaceably attached from the frame, the operator of the apparatus can use these tools combined, depending on the type and moisture content of the soil. Soil tracing mechanism can also be mounted on the frame 2, whereby the distance of the pipe and plastic tape can be maintained at a constant level from the ground surface, independently from irregularities of the ground.

The most important working tool of the equipment is a laying head 10 mounted on the end of the frame 10. Such construction is also feasible, when the laying equipment is provided with several laying heads 10. In this case the several irrigation pipes each combined with an appurtenant impermeable layer (tape) are laid in one run, next to each other, or at staggered levels, independently from the plant cultivation, soil conditions, and the purpose of irrigation. The laying head 10 is a hollow, wing-type subsoiler. A plastic tape dispensing drum 15 is arranged above the laying head and a pipe dispensing drum 16 is arranged behing the tape dispensing drum. The dispensing drums 15, and 16 can be positively driven or can run free, and they can be provided with an adjustable brake, depending on the quality of the materials to be laid. One or more pipes that can be stored on one or more dispensing drums, are generally made of plastic that is perforated for passing through the irrigation water from the pipe interior, and formed as corrugated tube for easy replacement. Suitably irrigation pipe formed as plastic hose wound up flat as a tape, can be used thus large quantity can be stored on a drum of small diameter.

Such plastic hose can be made in a pair, whereby the water distribution will be more homogeneous, and ingrowth of the root can also be prevented by the use of such hose. In the subsoil irrigation technology drain bodies are customarily implanted at equal distances from each other.

The plastic tape 14 from the drum 15 above the laying head 10 passes into the laying head 10 by winding off from the drum 15 and gradually being folded by guiding elements 24. The material of the tape 14 may be different from that of the pipe, but inexpensive polyethylene is most suitable for the purpose. The tape passes through guiding elements 11 in the hollow lower part 25 of the laying head 10 and guiding rollers 12 spread the tape to its full width, and then the opened up tape is embedded into the soil in a V-shape opened at the laying depth (FIG. 2). The condition of the laid plastic tape (wrinkle, tear) can be continuously checked with electronic sensors.

Irrigation pipe 17 passes from the pipe dispensing storage drum 16 through a curved sleeve or pipe 13 into the soil, where it is embedded in the positio shown in FIG. 2. The pipe 13 is formed to enable the laying of several pipes at the same time according to the nature of the irrigation.

The working tools of the apparatus according to the invention can be vibrated to reduce the traction resistance and to increase the porosity of the soil and enable correct embedding the plastic tape and pipe to be laid. This can be achieved by attaching a conventionaly hydraulic needle vibrator 8 to the tools. The lower hollow part 25 of the laying head 10 is covered by an arch to prevent the cavity formed in the soil by the laying head 10 from caving-in until the elements are embedded.

The horizontal flow of the moisture in the soil has to be frequently prevented in irrigation technology. In this case a vertical plastic tape is laid into the soil with the aid of a vertical plastic tape storage drum 19 mounted on the rear part of a the laying head 10.

Figure 6:
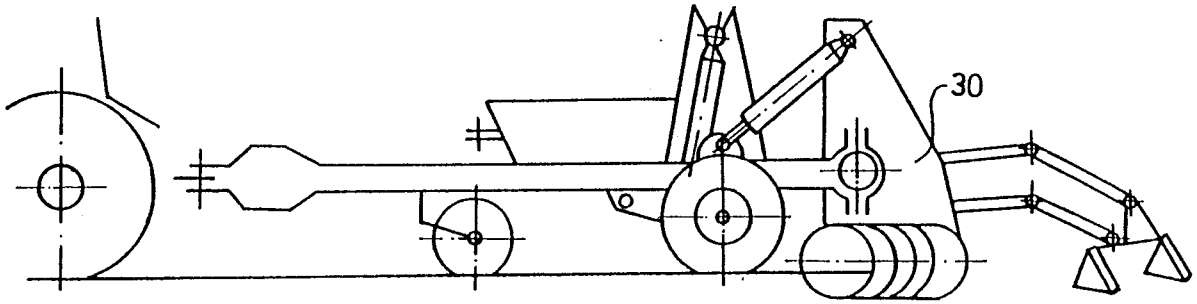
FIG. 6 is a side view of the tools used for backfilling the trench.

The laid pipe is supplied with irrigation water from the main water line arranged at right angle. When a digging of a trench is desired for the main waterline, a trench excavating plow 29 is mounted on frame 2 instead of the laying head 10. The trench is suitable for the excavation of a trench for the laying of a main water line with greater diameter than the irrigation pipe 17. The trench can be backfilled with a trench covering tool 30 (FIG. 6).

In operation of the apparatus of the invention, first the trenches of the main water line are excavated according to predetermined layout of the subsurface irrigation system. The apparatus of the present invention equipped with laying head 10 is employed for laying the tape and the pipe via the apparatus and its perpendicularly arranged plastic ducts, starting from the end of the open trench. After connection to the main irrigation pipes, the trenches are backfilled with the trench covering tool 30, and the subsurface irrigation system is ready for operation.

The main advantages of the apparatus according to the invention include:

- enabling economical irrigation on a large scale;
- providing accurate geometry and perfect embedding of the laid plastic tape;
- supplementary works can also be carried out by the same apparatus; and
- extensive use can be provided in an inexpensive fashion due to the replaceable and variable working tools.

I claim:

1. Apparatus for laying on the ground of plastic tape and pipe, which comprises:

(i) a frame for being moved over the surface of ground and for mounting the components of the apparatus;

(ii) one or more earth splitting tools attached to the frame for providing a slit in the ground as said frame is being moved;

(iii) a wing type hollow laying head attached to the frame, for widening underground said slit in the soil and for simultaneously laying plastic tape and pipe in said slit in the ground;

(iv) one or more dispensing drums each for the tape and for the pipe;

(v) guiding means for folding the plastic tape;

(vi) guiding means for unfolding the plastic tape within the underground widened slit; and (vii) means in said laying head for laying the opened tape and the pipe thereon in the underground widened slit.

2. The apparatus of claim 1, further comprising one or more vibrators attached to said one or more earth splitting tools.

3. The apparatus of claim 1, wherein said one or more earth splitting tools and said laying head are removably attached to said frame.

4. The apparatus of claim 1, further comprising one or more wheels for rollably supporting said frame, and means for adjusting the distance of said frame above said one or more wheels.

5. The apparatus of claim 1, further comprising means for vertically laying tape into the soil.

* * * * *